US011299815B2

(12) United States Patent
Ding et al.

(10) Patent No.: US 11,299,815 B2
(45) Date of Patent: *Apr. 12, 2022

(54) HIERARCHICALLY STRUCTURED DUPLEX ANODIZED ALUMINUM ALLOY

(71) Applicant: Raytheon Technologies Corporation, Farmington, CT (US)

(72) Inventors: Zhongfen (Vivian) Ding, South Windsor, CT (US); Georgios S. Zafiris, Glastonbury, CT (US); Mark R. Jaworowski, Sarasota, FL (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/063,069

(22) Filed: Oct. 5, 2020

(65) Prior Publication Data

US 2021/0040639 A1 Feb. 11, 2021

Related U.S. Application Data

(62) Division of application No. 16/121,931, filed on Sep. 5, 2018, now Pat. No. 10,793,966, which is a division of application No. 14/879,419, filed on Oct. 9, 2015, now Pat. No. 10,094,037.

(60) Provisional application No. 62/063,069, filed on Oct. 13, 2014.

(51) Int. Cl.

| | |
|---|---|
| ***C25D 11/12*** | (2006.01) |
| ***C25D 11/06*** | (2006.01) |
| ***C25D 11/02*** | (2006.01) |
| ***C25D 11/08*** | (2006.01) |
| ***C25D 11/10*** | (2006.01) |
| ***C25D 11/24*** | (2006.01) |

(52) U.S. Cl.

CPC ..... *C25D 11/12* (2013.01); *C25D 11/024* (2013.01); *C25D 11/06* (2013.01); *C25D 11/08* (2013.01); *C25D 11/10* (2013.01); *C25D 11/246* (2013.01)

(58) Field of Classification Search

CPC ..... C25D 11/12; C25D 11/06; C25D 11/024; C25D 11/08; C25D 11/10; C25D 11/246

See application file for complete search history.

(56) References Cited

U.S. PATENT DOCUMENTS

| | | | |
|---|---|---|---|
| 3,666,638 | A | 5/1972 | Harris et al. |
| 3,857,766 | A | 12/1974 | Woods |
| 4,133,725 | A | 1/1979 | Lerner et al. |

(Continued)

FOREIGN PATENT DOCUMENTS

| | | | |
|---|---|---|---|
| JP | 59050196 | A | 3/1984 |

OTHER PUBLICATIONS

European Office Action dated Feb. 6, 2018 for corresponding European Patent Application 15189596.8.

(Continued)

*Primary Examiner* — Hai Vo

(74) *Attorney, Agent, or Firm* — Bachman & LaPointe, P.C.

(57) ABSTRACT

A method of growing a hierarchically structured anodized film to an aluminum substrate including growing a Phosphoric Acid Anodizing (PAA) film layer to an aluminum substrate and growing a multiple of Tartaric-Sulfuric Acid Anodizing (TSA) film layers under the Phosphoric Acid Anodizing (PAA) film layer.

11 Claims, 4 Drawing Sheets

(56) References Cited

U.S. PATENT DOCUMENTS

| | | | | |
|---|---|---|---|---|
| 5,472,788 | A | 12/1995 | Benitez-Garriga | |
| 5,587,063 | A | 12/1996 | Kuhm et al. | |
| 5,674,371 | A | 10/1997 | Patel | |
| 6,027,629 | A | 2/2000 | Hisamoto et al. | |
| 6,126,808 | A | 10/2000 | Rasmussen | |
| 10,793,966 | B2 * | 10/2020 | Ding | C25D 11/024 |
| 2002/0157961 | A1 | 10/2002 | Dattilo et al. | |
| 2005/0150771 | A1 | 7/2005 | Kock et al. | |
| 2011/0120873 | A1 | 5/2011 | Kock et al. | |
| 2013/0032599 | A1 | 2/2013 | Musil et al. | |
| 2016/0312374 | A1 | 10/2016 | Duffy et al. | |
| 2017/0292202 | A1 | 10/2017 | Curran et al. | |

OTHER PUBLICATIONS

L. Iglesias-Rubianes et al.; Cyclic Oxidation Processes During Anodizing of A1-Cu Alloys; Electrochimica Acta, Elsevier Science Publishers, Barking, GB, vol. 52, No. 24, Jul. 9, 2007, pp. 7148-7157, XP022145588, ISSN: 0013-4686, DOI: 10.1016/J. Electacta. 2007.05.052.

Y. Ma et al.; Anodic Film Formation on AA 2099-T8 Aluminum Alloy in Tartaric-Sulfuric Acid; Journal of the Electrochemical Society, vol. 158, No. 2, Dec. 15, 2010, pp. C17, XP055250993, ISSN: 0013-4651, DOI: 10.1149/1.3523262.

Curioni et al., "Role of Tartaric Acid on the Anodizing and Corrosion Behavior of AA2024 T3 Aluminum Alloy", 2009 156 (4) C147-C153. (Year: 2009).

* cited by examiner

HIERARCHICALLY STRUCTURED DUPLEX ANODIZED ALUMINUM ALLOY

CROSS REFERENCE TO RELATED APPLICATIONS

This application is a divisional application of U.S. patent application Ser. No. 16/121,931, filed Sep. 5, 2018, which is a divisional application of U.S. patent application Ser. No. 14/879,419, filed Oct. 9, 2015, now U.S. Pat. No. 10,094,037, issued Oct. 9, 2018, which claims benefit of U.S. patent application Ser. No. 62/063,069, filed Oct. 13, 2014.

BACKGROUND

The present disclosure relates to components for a gas turbine engine and, more particularly, to a anodizing process.

Densely anodized film for aluminum alloys is typically utilized for corrosion protection, whereas textured anodized film is typically utilized for structural bonding. Anodizing can provide both adhesive strength, and corrosion protection. However, densely anodized film may still be relatively porous in nature, with the porosity being relatively low. Such films are typically primed and sealed for corrosion protection but and may debit mechanical properties, which should not be compromised in structural applications.

SUMMARY

A method of growing a hierarchically structured anodized film to an aluminum substrate, according to one disclosed non-limiting embodiment of the present disclosure includes, growing a Phosphoric Acid Anodizing (PAA) film layer to an aluminum substrate; and growing a stepped growth Tartaric-Sulfuric Acid (TSA) film layer underneath the Phosphoric Acid Anodizing (PAA) film layer.

A further embodiment of the present disclosure includes the method, wherein the stepped growth TSA film layer is applied utilizing a repeating ramped voltage.

A further embodiment of any of the foregoing embodiments of the present disclosure includes the method, wherein the stepped growth TSA film layer is applied utilizing a repeating stepped voltage.

A further embodiment of any of the foregoing embodiments of the present disclosure includes the method, wherein the stepped growth TSA film layer is applied utilizing a high voltage and a low voltage.

A further embodiment of any of the foregoing embodiments of the present disclosure includes the method, wherein the stepped growth TSA film layer directly adjacent to the Phosphoric Acid Anodizing (PAA) film layer is initially applied utilizing the high voltage.

A further embodiment of any of the foregoing embodiments of the present disclosure includes the method, wherein the high voltage is about 15V+/−3V.

A further embodiment of any of the foregoing embodiments of the present disclosure includes the method, wherein a difference between the high voltage and the low voltage is greater than about 4V.

A further embodiment of any of the foregoing embodiments of the present disclosure includes the method, wherein the stepped growth TSA film layer directly adjacent to the Phosphoric Acid Anodizing (PAA) film layer is initially applied utilizing the low voltage.

A further embodiment of any of the foregoing embodiments of the present disclosure includes the method, wherein the low voltage is about 10V+/−3V.

A further embodiment of any of the foregoing embodiments of the present disclosure includes the method, wherein a difference between the high voltage and the low voltage is greater than about 4V.

An hierarchically structured anodized film for an aluminum substrate according to another disclosed non-limiting embodiment of the present disclosure includes a stepped growth Tartaric-Sulfuric Acid (TSA) film layer.

A further embodiment of any of the foregoing embodiments of the present disclosure includes the hierarchically structured anodized film, wherein the stepped growth TSA film layer has a multiple of densities therein.

A further embodiment of any of the foregoing embodiments of the present disclosure includes the hierarchically structured anodized film, wherein the stepped growth TSA film layer has a multiple of porosities therein.

A further embodiment of any of the foregoing embodiments of the present disclosure includes the hierarchically structured anodized film, wherein the stepped growth TSA film layer is formed via a multiple of different repeating anodizing voltages A method of growing a hierarchically structured anodized film to an aluminum substrate, according to another disclosed non-limiting embodiment of the present disclosure includes applying a first voltage to an aluminum alloy workpiece within a Tartaric-Sulfuric Acid (TSA) solution; applying a second voltage different than the first voltage while the aluminum alloy workpiece is in the Tartaric-Sulfuric Acid (TSA) solution.

A further embodiment of any of the foregoing embodiments of the present disclosure includes, wherein the second voltage is a higher voltage than the first voltage.

A further embodiment of any of the foregoing embodiments of the present disclosure includes, wherein the high voltage is about 15V+/−3V.

A further embodiment of any of the foregoing embodiments of the present disclosure includes, wherein the second voltage is a lower voltage than the first voltage.

A further embodiment of any of the foregoing embodiments of the present disclosure includes, wherein the lower voltage is about 10V+/−3V.

A further embodiment of any of the foregoing embodiments of the present disclosure includes, further comprising ramping to at least one of the first voltage and the second voltage within a predetermined time period.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
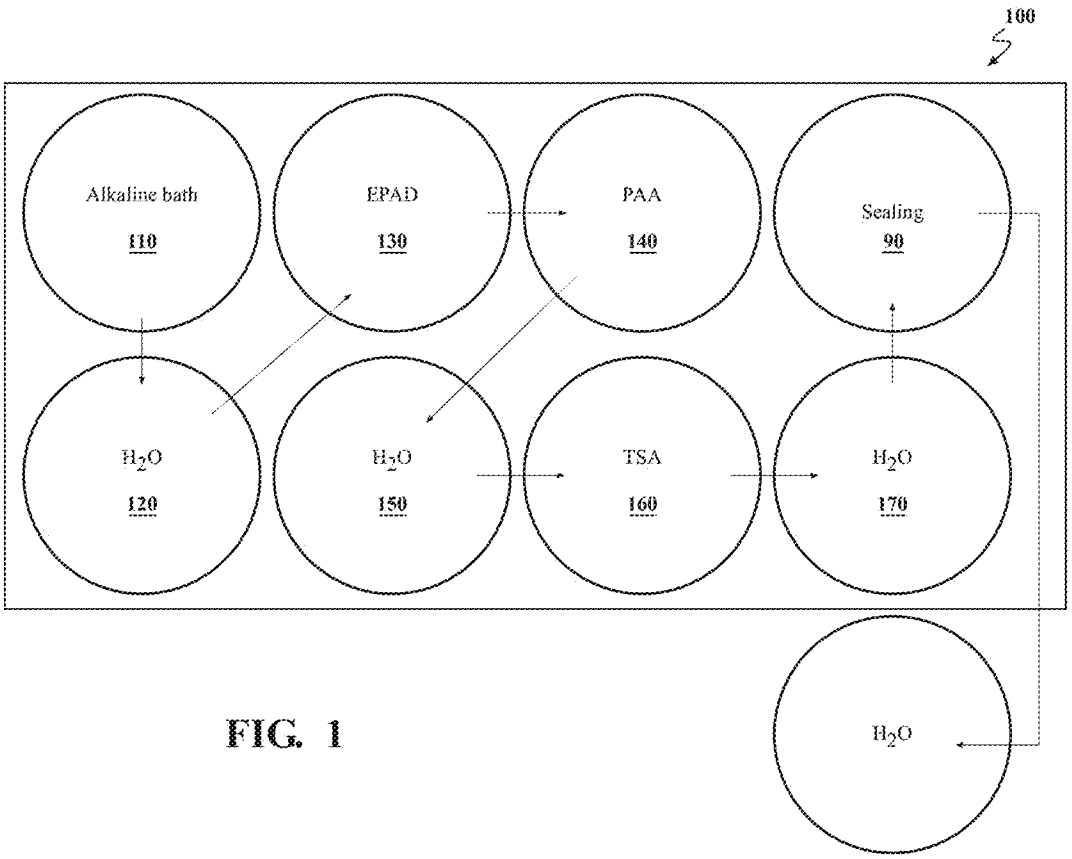
FIG. 1 is a flow chart illustrating a anodized film process.

FIG. 1 schematically illustrates an example anodizing process 100 to form a hierarchically structured anodized film 10 (FIG. 2). The steps of the process 100 are schematically disclosed in terms of functional block diagrams as a flowchart of steps. It should be appreciated that alternative of additional steps may be provided without departing from the teaching herein.

Initially, a workpiece with an aluminum alloy substrate 20 (FIG. 2) such as an aircraft component, is immersed in an alkaline bath (step 110). In one particular non-limiting embodiment, the substrate 20 is alkaline cleaned for 20 minutes at 130-150 F (54-65 C).

Next, the workpiece is cleansed in a water bath (step 120).

Next, the workpiece subjected to an electrolytic phosphoric acid deoxidizing stage (EPAD) (step 130). In this particular non-limiting embodiment, the phosphoric acid is a 15% acid solution at about 85 F (29 C) with a voltage application to the workpiece of 7.5V, for 15 minutes.

Next, the workpiece is immersed in a phosphoric acid anodizing (PAA) solution (step 140). In this particular non-limiting embodiment, the phosphoric acid is a 7.5% acid solution with a voltage application to the workpiece of 15V, for about 20-25 minutes. Generally, the PAA solution and the voltage form a porous oxide layer on the aluminum alloy workpiece. For example, the porous oxide layer has aluminum oxides and phosphates. The porous oxide layer is a relatively thin and porous PAA film layer 30 that is initially on the surface of the workpiece (FIG. 2A, 2B) for adhesive strength prior to growing a stepped growth TSA film layer 40. It should be appreciated that the relatively thin and porous PAA film layer 30 is optional and that the anodizing is a process of oxidizing Al into Aluminum oxide, such that the coating grows from the substrate/electrolyte interface down toward the aluminum substrate.

The workpiece is then again cleansed in a water bath (step 150).

Next, the workpiece is immersed in a Tartaric-Sulfuric Acid (TSA) solution (step 160) to form a stepped growth TSA film layer 40 at different anodizing voltages. For example, the concentration of the tartaric acid can be about 60-100 gram/L while voltage is applied at different anodizing voltages. The tartaric acid facilitates the formation of the dense oxide layer, but its action is not so severe such to dissolve the porous oxide layer. That is, the TSA film layer 40 grows from the substrate/electrolyte interface essentially under the PAA film layer.

Figure 4:
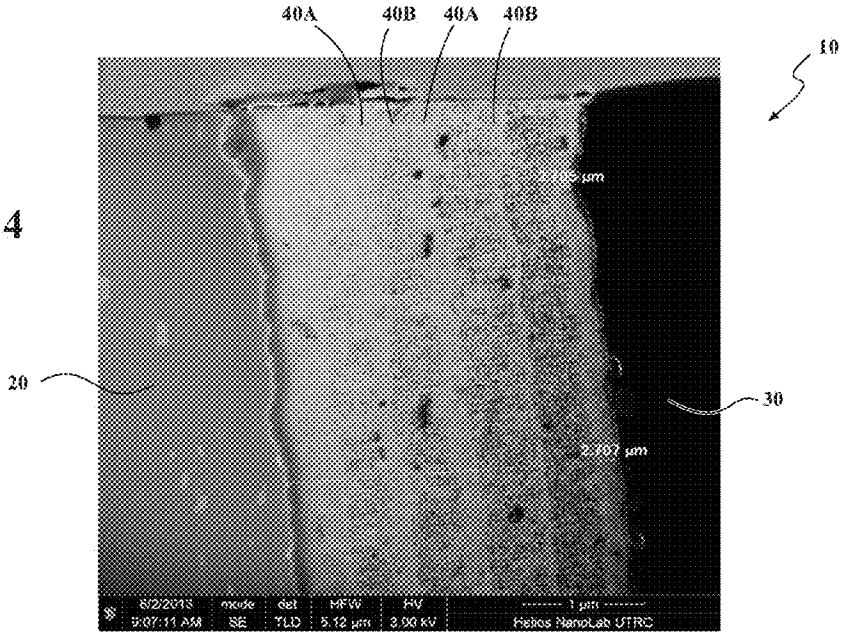
FIG. 4 is a micrograph of an aluminum substrate with the anodized film process applied thereto.

In this disclosed non-limiting embodiment, the voltage application to the workpiece is in multiple voltage control steps to form the stepped growth TSA film layer 40. For example the multiple voltage control steps include, 13V for 3 minutes, 6V for 3 minutes, 13V for 3 minutes, 6 V for 3 minutes, etc. to generate each layer. In another example, the multiple voltage control steps include, 13V for 10 minute, 9 V for 10 minutes, etc. In still another example, the bath temperature of the Tartaric-Sulfuric Acid (TSA) solution is lowered (from about 35 C to 22 C), while the voltage is switched from 13V for 10 minutes, then 20V for 10 minutes, 13V for 10 minutes, then 20V for 10 minutes, etc. it should be appreciated that the voltages may be changed in a step function arrangement between the at least two voltages, or may be adjusted via a ramp function, e.g., ramping up to 13V in 130 seconds, or ramping up to 13V in 60 seconds, etc. Generally, the different anodizing voltages forms a relatively thick and dense stepped growth TSA film layer 40, relative to the PAA film layer 30 (FIG. 2). The resulting coating is a coating with the stepped growth TSA film layer 40 formed underneath the porous PAA layer (FIG. 4, cross section SEM image).

The workpiece is then again cleansed in a water bath (step 170).

Lastly, as the stepped growth TSA film layer 40 is relatively thick and soft, e.g., porous, a sealing process (step 90) may be performed to facilitate corrosion resistance. The sealing process may include immersion by immersion in a nitrilotrismethylene (NTMP) solution and/or an aqueous trivalent chromium-containing sealing solution. The NTMP solution acts to stabilize the porous oxide layer, to enhance bonding with a later-applied adhesive, such as epoxy, and to improve the corrosion barrier properties of the oxide layer. The aqueous chromium solution seals the dense oxide layer through formation of a chromium compound in the dense oxide layer. Therefore, the NTMP solution and the aqueous chromium solution can be used singly or in cooperation, with the NTMP solution enhancing bonding and the aqueous chromium solution enhancing corrosion resistance.

The above-described steps for formation of the TSA film layer 40 may then be repeated as desired.

Figure 3:
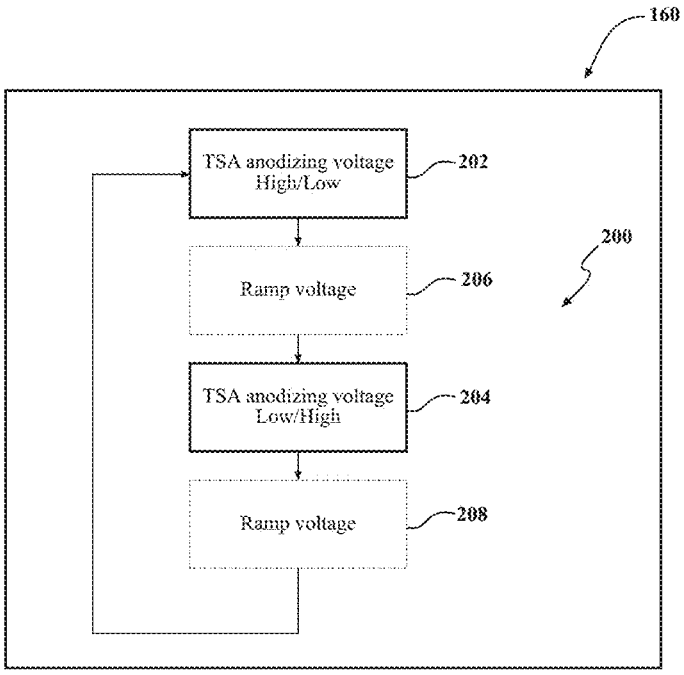
FIG. 3 is a flow chart of voltage control steps for growing a hierarchically structured duplex anodized film layer.

With reference to FIG. 3, a process 200 to control the multiple voltage control steps (step 160) to form the stepped growth TSA film layer 40 is schematically disclosed in terms of a flowchart with functional block diagrams. It should be appreciated that alternative of addition steps may be provided without departing from the teaching herein.

Figure 2A:
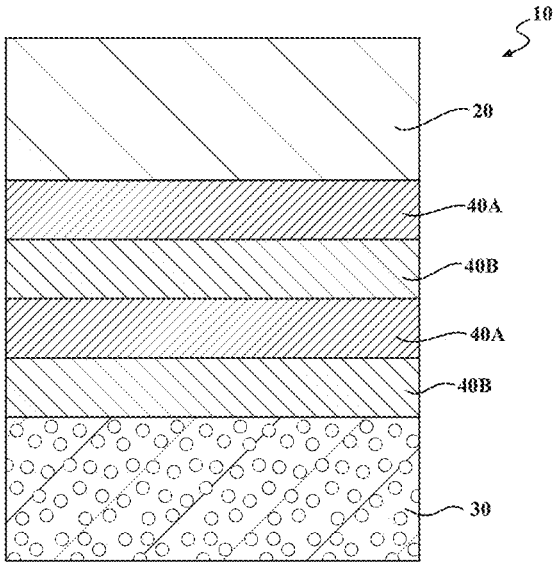
FIGS. 2A-2B are schematic cross sections of a hierarchically structured anodized film applied to the aluminum substrate with the anodized film process applied thereto.
Figure 2B:
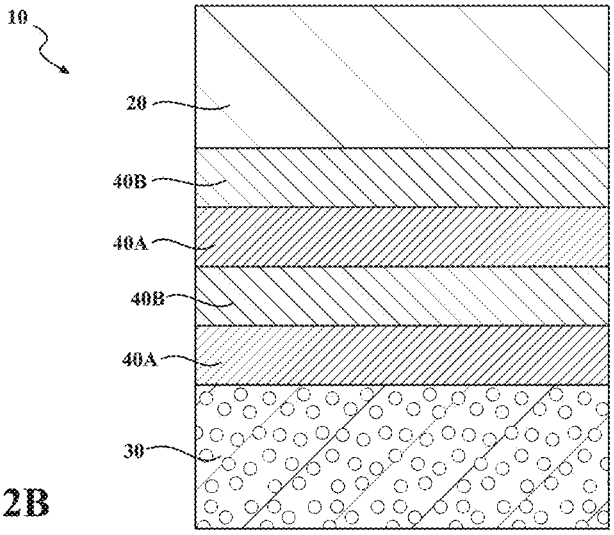

In one disclosed non-limiting embodiment, the anodizing voltage of the process 200 is controlled in at least two steps (step 202, 204). In one example, the TSA utilizes a "high" anodizing voltage followed by a 'low" anodizing voltage in repeating step function manner to grow a relatively low density TSA film layer 40B then a relatively high density TSA film layer 40A (FIG. 2A). Alternatively, the TSA utilizes a "low" anodizing voltage followed by a 'high" anodizing voltage in repeating step function manner to grow a relatively high density TSA film layer 40A then a relatively low dense TSA film layer 40B (FIG. 2B). In one example, the high voltage is about 15V+/−3V and the low voltage is about 10V+/−3V. Alternatively, or in addition, a difference between the high and low voltage is at least about 4V. In another disclosed non-limiting embodiment, the anodizing voltage of the process 200 is ramped up (step 206, 208) for each or either of the at least two steps (step 202, 204).

The higher voltage anodizing results in a growth rate that is higher and thus more porous to grow a relatively low density TSA film layer 40B, while lower voltage anodizing results in a growth rate that is lower, yet less porous to form the relatively high density TSA film layer 40A. Alternating the voltage between the relatively higher voltage and the relatively lower voltage results in a less porous layer underneath a more porous layer. Alternating High/Low/High/Low/ . . . provides a relatively lower mechanical fatigue debit compared to a dense coating grown with but one constant voltage. Alternating High/Low/High/Low/ . . . also forms a growth pattern with an effective anodized coating at sharp corners, where film grown under a constant voltage has heretofore been prone to crack. Generally, a relatively lower growth rate results in a relatively more dense film layer, while a relatively higher growth rate result in a relatively more porous film layer.

In one example application, structural adhesive bonding of dissimilar materials to fatigue-sensitive aluminum alloys is facilitated by the anodizing process 100. The hierarchical coating allows for development of a thick anodized layer for improved impact and electrical isolation while maintaining a dense layer at the metal interface to serve as a corrosion barrier without creating an excessive mechanical fatigue debit.

In another example application, the hierarchical coating allows for a high level of adhesion of protective paint and a controlled infiltration of corrosion-inhibitive anodized sealant into the outer dense layer such as for aircraft skin structures. This provides for superior paint durability and a reservoir of corrosion protection in areas where paint may be removed by impact damage.

The hierarchically structured anodized film 10 can be readily tailored to reduce mechanical fatigue debit, increase bonding strength, and/or increase corrosion resistance.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. A hierarchically structured anodized film for an aluminum substrate, comprising:

a stepped growth Tartaric-Sulfuric Acid (TSA) film layer comprising a tartaric acid, a sulfuric acid and an aluminum oxide, wherein the stepped growth TSA film is a porous film comprising alternating TSA layers of a first layer having a first density and a second layer having a second density different from the first density; and further comprising a phosphoric acid anodizing (PAA) film layer on said stepped growth TSA film layer, wherein said phosphoric acid anodizing (PAA) film layer is a porous oxide layer comprising phosphate and aluminum oxide.

2. The hierarchically structured anodized film as recited in claim 1, wherein said stepped growth TSA film layer has a multiple of densities therein.

3. The hierarchically structured anodized film as recited in claim 1, wherein said stepped growth TSA film layer has a multiple of porosities therein.

4. The hierarchically structured anodized film as recited in claim 1, wherein said stepped growth TSA film layer is formed via a multiple of different repeating anodizing voltages.

5. The hierarchically structured anodized film as recited in claim 1, wherein said stepped growth TSA film layer is thicker and denser than said PAA film layer.

6. The hierarchically structured anodized film as recited in claim 1, wherein the concentration of the tartaric acid is 60-100 gram/L.

7. The hierarchically structured anodized film as recited in claim 1, wherein said stepped growth TSA film layer is sealed.

8. The hierarchically structured anodized film as recited in claim 1, wherein said stepped growth TSA film layer is sealed with a chromium compound.

9. The hierarchically structured anodized film as recited in claim 1, wherein said stepped growth TSA film layer comprises alternating porosities therein.

10. The hierarchically structured anodized film as recited in claim 1, wherein said stepped growth TSA film layer is located at a sharp corner of the aluminum substrate.

11. The hierarchically structured anodized film as recited in claim 1, wherein said tartaric acid facilitates formation of the stepped growth TSA film layer, but does not dissolve the PAA film layer.

* * * * *